US006774321B2

(12) United States Patent
Komatsu et al.

(10) Patent No.: US 6,774,321 B2
(45) Date of Patent: Aug. 10, 2004

(54) MULTI-STAGE PUSH OPERATING SWITCH DEVICE, ALLOWING ACQUISITION OF CLEAR CLICK FEELING

(75) Inventors: Shinji Komatsu, Miyagi-ken (JP); Mikio Sasaki, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/675,551

(22) Filed: Sep. 30, 2003

(65) Prior Publication Data

US 2004/0074755 A1 Apr. 22, 2004

(30) Foreign Application Priority Data

Oct. 8, 2002 (JP) ..... 2002-294966

(51) Int. Cl.[7] ..... H01H 13/00
(52) U.S. Cl. ..... 200/1 B; 200/341
(58) Field of Search ..... 200/1 B, 4, 5 R, 200/5 A, 18, 512, 517, 341, 345

(56) References Cited

U.S. PATENT DOCUMENTS 5,430,261 A * 7/1995 Malone ..... 200/1 B
5,693,920 A 12/1997 Maeda
5,834,716 A * 11/1998 Lee ..... 200/5 R
5,907,138 A * 5/1999 Metzler ..... 200/1 B
6,303,887 B1 * 10/2001 Ando ..... 200/512
6,437,259 B1 * 8/2002 Geppert et al. ..... 200/5 R
6,603,086 B2 * 8/2003 Kawaguchi et al. ..... 200/517
6,653,586 B2 * 11/2003 Hsiung et al. ..... 200/517

FOREIGN PATENT DOCUMENTS

JP Hei 06-52752 2/1994
JP 2000-188037 7/2000

* cited by examiner

*Primary Examiner*—Michael A. Friedhofer
(74) *Attorney, Agent, or Firm*—Brinks Hofer Gilson & Lione

(57) ABSTRACT

A switch device includes a first rubber switch having a dome provided with a movable contact on an inner ceiling; a second rubber switch having a dome provided with a movable contact on an inner ceiling; a plate spring mounted in a fixed manner onto a holder; a coil spring urged to a direction to space a slider away from a printed board; engagement sections for giving click feelings which are provided on the plate spring; engagement sections to be engaged with the aforementioned engagement sections for giving click feelings; and a pressing force absorbing section provided on the first rubber switch to absorb a pressing force from the slider.

4 Claims, 9 Drawing Sheets

MULTI-STAGE PUSH OPERATING SWITCH DEVICE, ALLOWING ACQUISITION OF CLEAR CLICK FEELING

BACKGROUND OF THE INVENTION

1. Field of the Invention

The present invention relates to a multi-stage push operating switch device for use with an apparatus for opening or closing a window of an automobile or the like, which allows acquisition of first- and second-stage click feelings in response to a push-down amount of a slider, as well as outputting electric signals.

2. Description of the Related Art

Conventionally, a two-stage movement seesaw switch apparatus which outputs a first-stage and a second-stage electric signals in response to an operation of a manually operable knob has been proposed by the assignee of the present application, for example in Patent Reference 1.

FIG. 11 is a plan view of the two-stage movement seesaw switch apparatus of the type mentioned above; FIG. 12 is a plan view of the two-stage movement seesaw switch apparatus of FIG. 11 with a manually operable knob removed; and FIGS. 13A to 13C are to illustrate movement of the two-stage movement seesaw switch apparatus of FIG. 11, corresponding to sectional views taken along line 13—13 of FIG. 11.

Referring to FIGS. 11 to 13C, the conventional two-stage movement seesaw switch apparatus includes a manually operable knob 2 supported for rocking motion on a casing 1, a pair of operation plates 3 and 4 disposed in a juxtaposed relationship in the inside of the casing 1 for being pressed by the manually operable knob 2, a base plate 6 having a pair of fixed contacts 5*a* and 5*b* thereon, and a click rubber member 8 in the form of a sheet disposed between the base plate 6 and the operation plates 3 and 4 and having a plurality of hollow projections 8*a* and 8*b*. A pair of movable contacts 7*a* and 7*b* are provided in an opposing relationship to the fixed contacts 5*a* and 5*b* in the hollow projections 8*a* and 8*b*, respectively. A damping member 3*a* is mounted on a surface of the operation plate 3 on the left side of the center of pivotal motion of the manually operable knob 2 such that, when the manually operable knob 2 is tilted leftwardly, a projection 2*a* provided on the bottom side of the manually operable knob 2 presses the operation plate 3 by way of the damping member 3*a*. Meanwhile, a damping member 4*a* is mounted on a surface of the other operation plate 4 on the right side of the center of pivotal motion of the manually operable knob 2 such that another projection not shown provided on the bottom side of the manually operable knob 2 presses the operations plate 4 by way of the damping member 4*a*. It is to be noted that the fixed contact 5*a* and the movable contact 7*a* cooperate with each other to form a push switch which is operated by the operation plate 3, and simultaneously, the fixed contact 5*b* and the movable contact 7*b* cooperate with each other to form another push switch which is operated by the operation plate 3. Similarly, another set of push switches (not shown) are provided for the other operation plate 4.

In the above two-stage movement seesaw switch apparatus, if, when it is in an inoperative condition shown in FIG. 13A, the manually operable knob 2 is tilted to the left side in FIG. 13A against the resilient force of the click rubber member 8, then the operation plate 3 is pressed by way of the damping member 3*a* located in the tilting direction, whereupon the operation plate 3 is first pivoted in the tilting direction around the hollow projection 8B which is comparatively remote from the acting point of the pressing force. Thereupon, the hollow projection 8A of the click rubber member 8 positioned in the tilting direction is pressed by the operation plate 3, and consequently, the hollow projection 8*a* is yieldably deformed as shown in FIG. 13B to provide a click feeling. Further, since the movable contact 7*a* provided on the hollow projection 8*a* is thereafter brought into contact with the fixed contact 5*a* opposing thereto, a first-stage electric signal is outputted in accordance with the tilting direction of the manually operable knob 2. If the manually operable knob 2 is further pushed to the left side in FIG. 13B, the operation plate 3 is pivoted in the direction opposite to the initial tilting direction around the hollow projection 8*a*, whereupon the other hollow projection 8*b* is pressed by the operation plate 3 Consequently, the hollow projection 8*b* is yieldably deformed as shown in FIG. 13C to produce a second click feeling. Further, since the movable contact 7*b* provided on the hollow projection 8*b* is thereafter brought into contact with the fixed contact 5*b* opposing thereto, a second-stage electric signal is outputted in accordance with the tilting direction and tilting angle of the manually operable knob 2. Then, if the tilting force applied to the manually operable knob 2 is cancelled, then the manually operable knob 2 is returned to its neutral position by way of the operation plate 3 by the resilient forces of the hollow projections 8*a* and 8*b* of the click rubber member 8, while the hollow projections 8*a* and 8*b* return to their individual non-operated conditions by their own resilient forces. Consequently, the movable contacts 7*a* and 7*b* are spaced away from the fixed contacts 5*a* and 5*b* and return to their initial off conditions, respectively.

On the other hand, if, when the two-stage movement seesaw switch apparatus is in the inoperative condition shown in FIG. 13A, the manually operable knob 2 is tilted to the right side in FIG. 13A, then since the other operation plate 4 is pressed by the manually operable knob 2 by way of the damping member 4*a*, first- and second-stage electric signals are outputted in response to a tilting angle from the set of push switches corresponding to the operation plate 4 similarly to the case described above wherein the operation plate 3 is pressed.

[Patent Reference]1

The Gazette of Japanese Unexamined Patent Publication No. Hei 08-111142, (corresponding to U.S. Pat. No. 5,693,920) pages 2 to 3, FIG. 6 to FIG. 8.

In the meantime, there is a strong demand for size reduction as to the above two-stage movement seesaw switch apparatus that is described in the patent document 1. When one rubber switch is pressed down to a bottom point, the narrower a distance between the two rubber switches are made, the larger interference to the other rubber switch may occur. Therefore, there has been a problem that a clear click feeling cannot be obtained.

Further, a rubber mat die is used to mold the rubber switch. In order to obtain two-stage click feeling, if the die is designed such that one rubber switch out of the two switches inverted with 100 g and the other is inverted with 200 g, molding by the rubber mat die generally causes an error of approximately ±50 g. Therefore, there has been a problem that several modifications with the rubber mat die are required so as to adjust the click feeling, thereby causing a long developing period of time.

SUMMARY OF THE INVENTION

The present invention has been made to solve such defects of the conventional art, and the objective of the present invention is to provide a multi-stage push operating switch device, with which it is possible to obtain a clear click feeling even with a narrower distance between the first and the second rubber switches, so that a planar dimension of a product can be made smaller, as well as preventing the developing time period from being extended.

The objective of the present invention as described above can be achieved by providing a multi-stage push operating switch device including:

a holder;

a first rubber'switch having a dome provided with a movable contact on an inner ceiling;

a second rubber switch having a dome provided with a movable contact on an inner ceiling;

a printed board on which a fixed contact is formed;

a slider provided with actuating portions for pressing the domes of the first and the second rubber switches, respectively, the slider being movable in a direction to apply a pressure onto each of the domes;

a plate spring mounted in a fixed manner on to the holder;

a coil spring urged to a direction to space the slider away from the printed board; engagement sections for giving click feelings, which are provided on one of the plate spring and the slider;

engagement sections to be engaged with the engagement sections for giving click feelings, which are provided on the other of the plate spring and the slider;

a pressing force absorbing section provided on the first rubber switch to absorb a pressing force from the slider.

Further, the objective of the present invention can be achieved by that the pressing force absorbing section is formed as a projection molded integrally with the dome of the first rubber switch.

The objective of the present invention is achieved by that the plate spring is provided with a bottom plate, and plates which are formed by bending edges of the bottom plate upwardly, and the plate spring is mounted on the holder fixedly, by elastically contacting a lower edge of the coil spring with the bottom plate.

The objective of the present invention is also achieved by that a hollow is provided within the slider to contain and hold an upper edge of the coil spring, a pair of engagement sections of the slider are respectively provided on both opposed sides on an outer surface of the slider, and the first rubber switch and the second rubber switch are arranged in such a manner as sandwiching the hollow, and being positioned orthogonal with a line connecting the pair of the engagement sections of the sliders.

Figure 8:
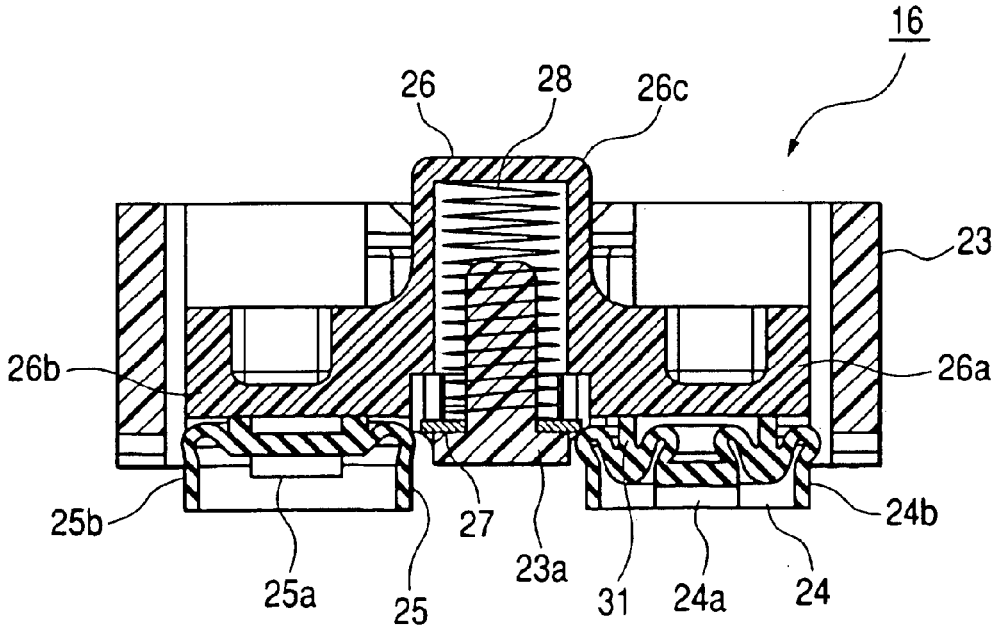
Figure 9:
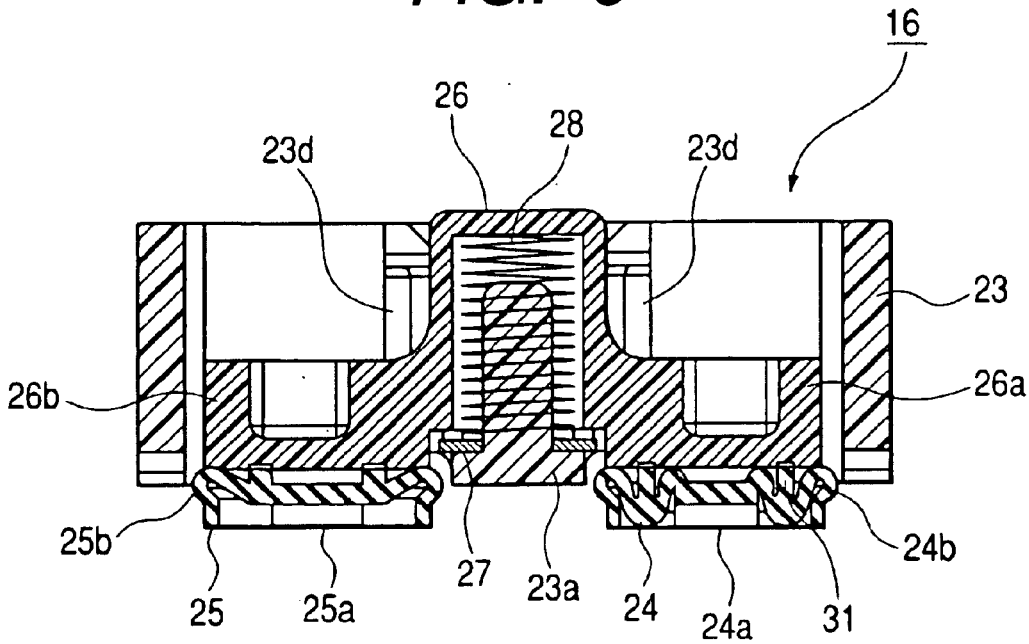
Figure 10:
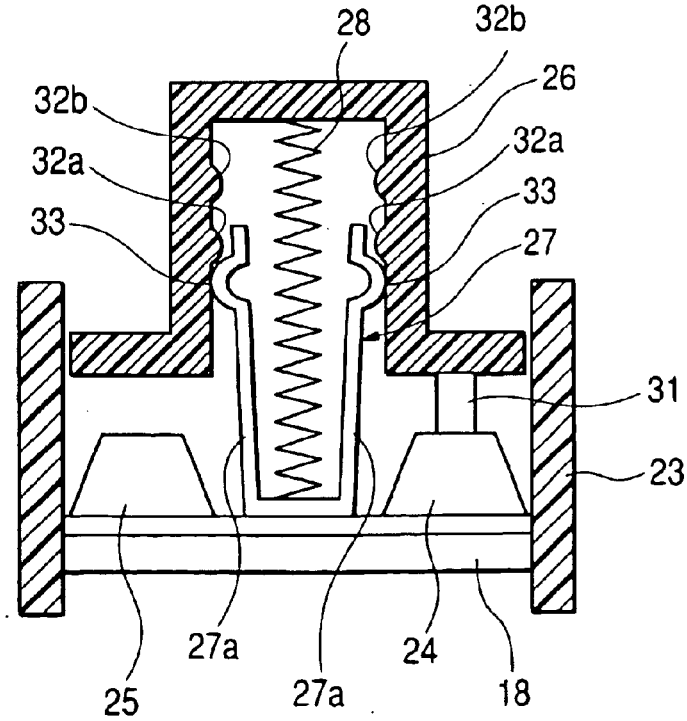
Figure 11:
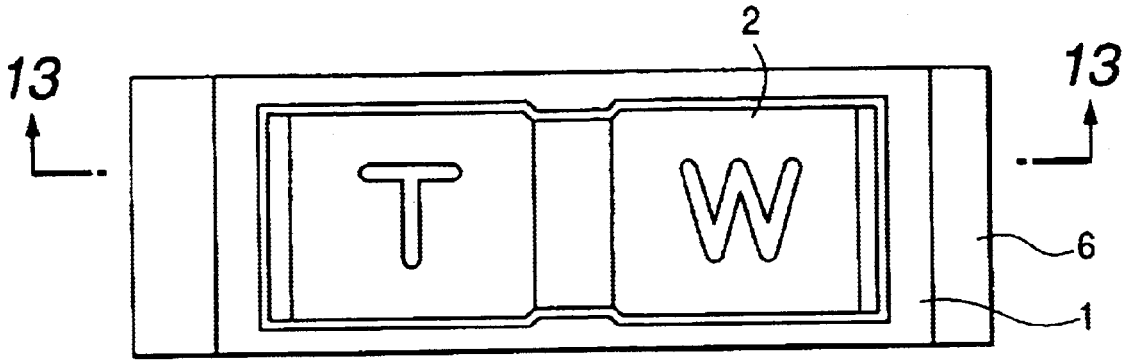
FIG. 11 PRIOR ART
Figure 12:
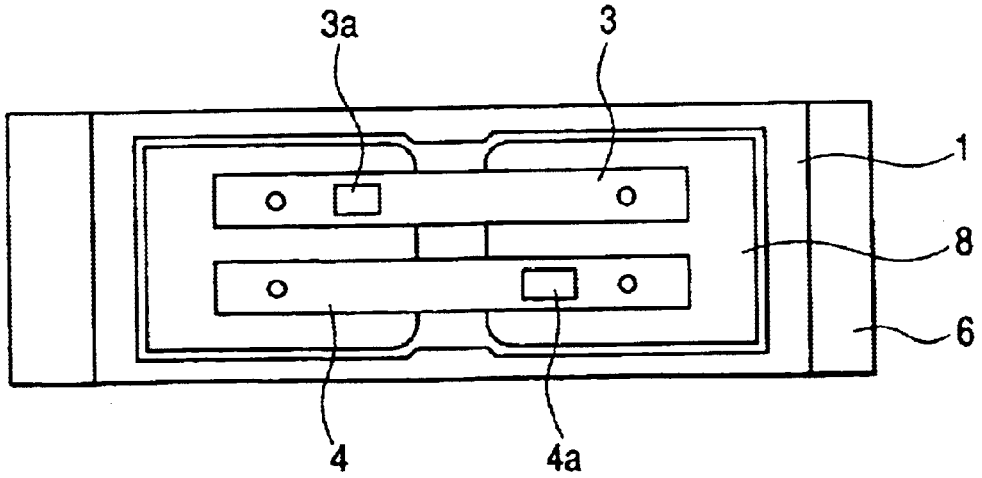
FIG. 12 PRIOR ART
Figure 13A:
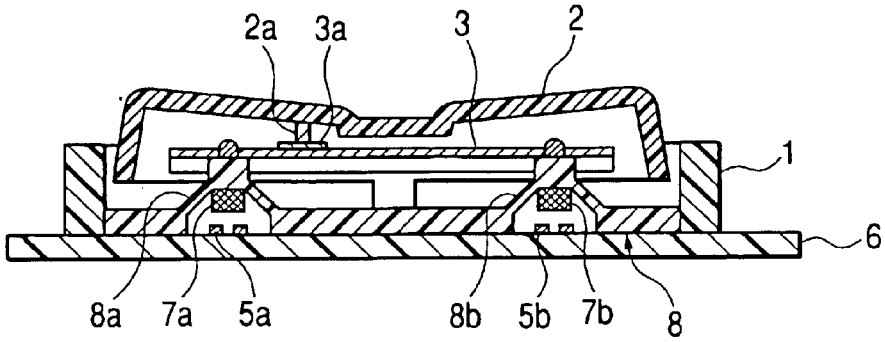
FIG. 13A PRIOR ART
Figure 13B:
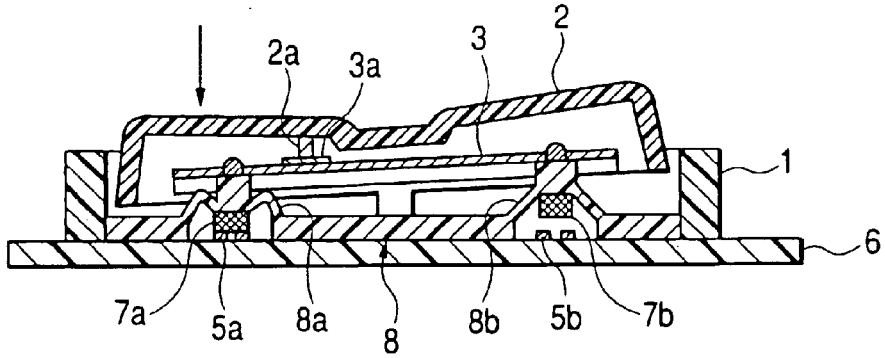
FIG. 13B PRIOR ART
Figure 13C:
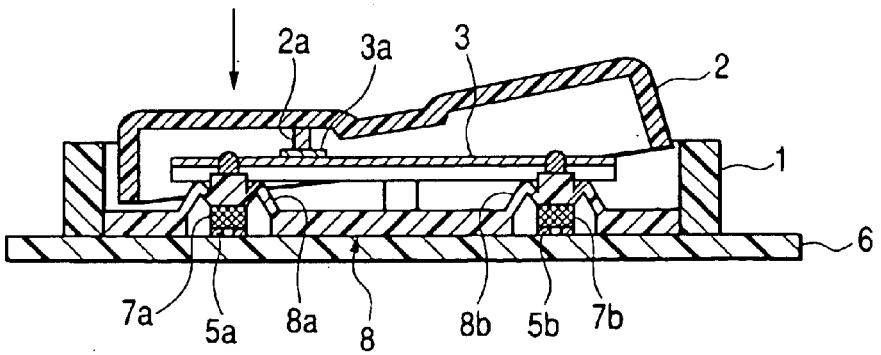
FIG. 13C PRIOR ART

FIG: 7 is an illustration showing inoperative condition of a slider;

FIG. 8 is an illustration showing a condition where the slider of the multi-stage push operating switch device is pushed down to the first stage;

FIG. 9 is an illustration showing a condition where the slider of the multi-stage push operating switch device is pressed down to the second stage;

FIG. 10 is a vertical cross sectional view of the multi-stage push operating'switch device relating another embodiment of the present invention;

FIG. 11 is a plan view of a conventional two-stage movement seesaw switch apparatus;

FIG. 12 is a plan view showing a state the manually operable knob is removed from the two-stage movement seesaw switch apparatus of FIG. 11; and FIG. 13 is an illustration to explain movement of the two-stage movement seesaw switch apparatus of FIG. 11.

DESCRIPTION OF THE PREFERRED EMBODIMENTS

Hereinafter, preferred embodiments of the present invention will be described referring to the attached drawings.

Figure 4:
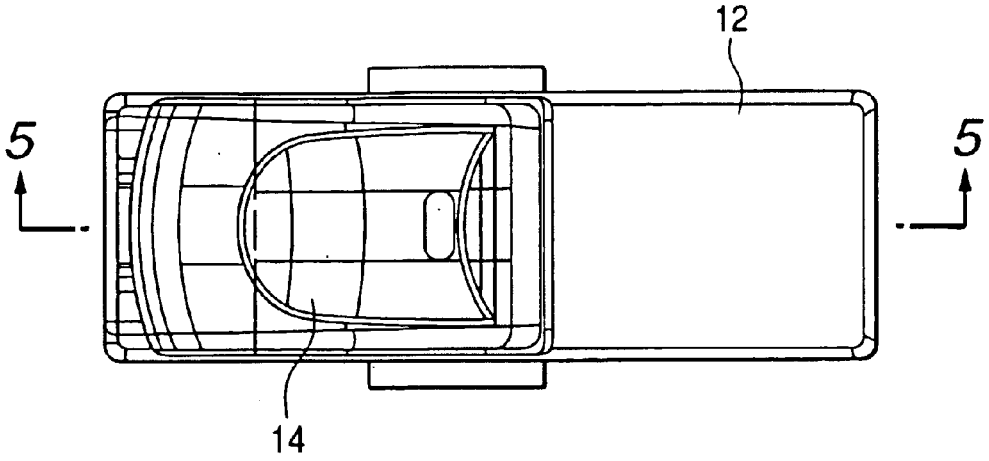
FIG. 4 is a plan view of an automatic window unit of an automobile, to which the multi-stage push operating switch device is applied.
Figure 5:
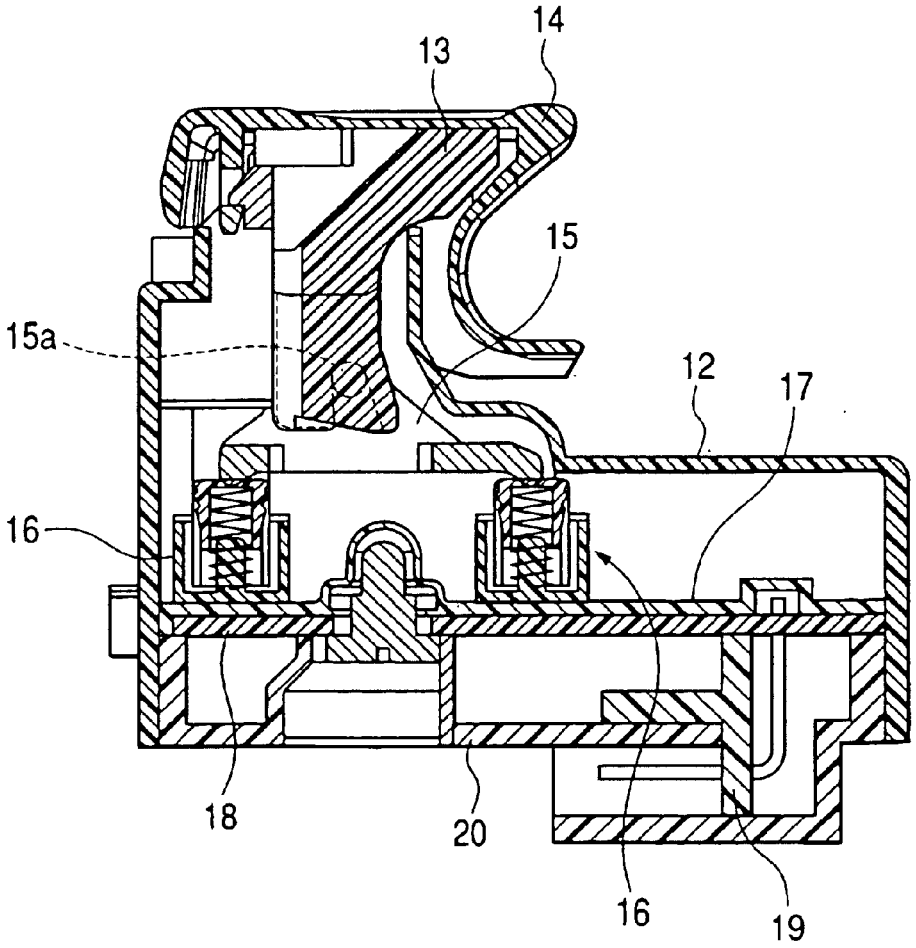
FIG. 5 is a cross sectional view taken along the line 5—5 of FIG. 4.
Figure 6:
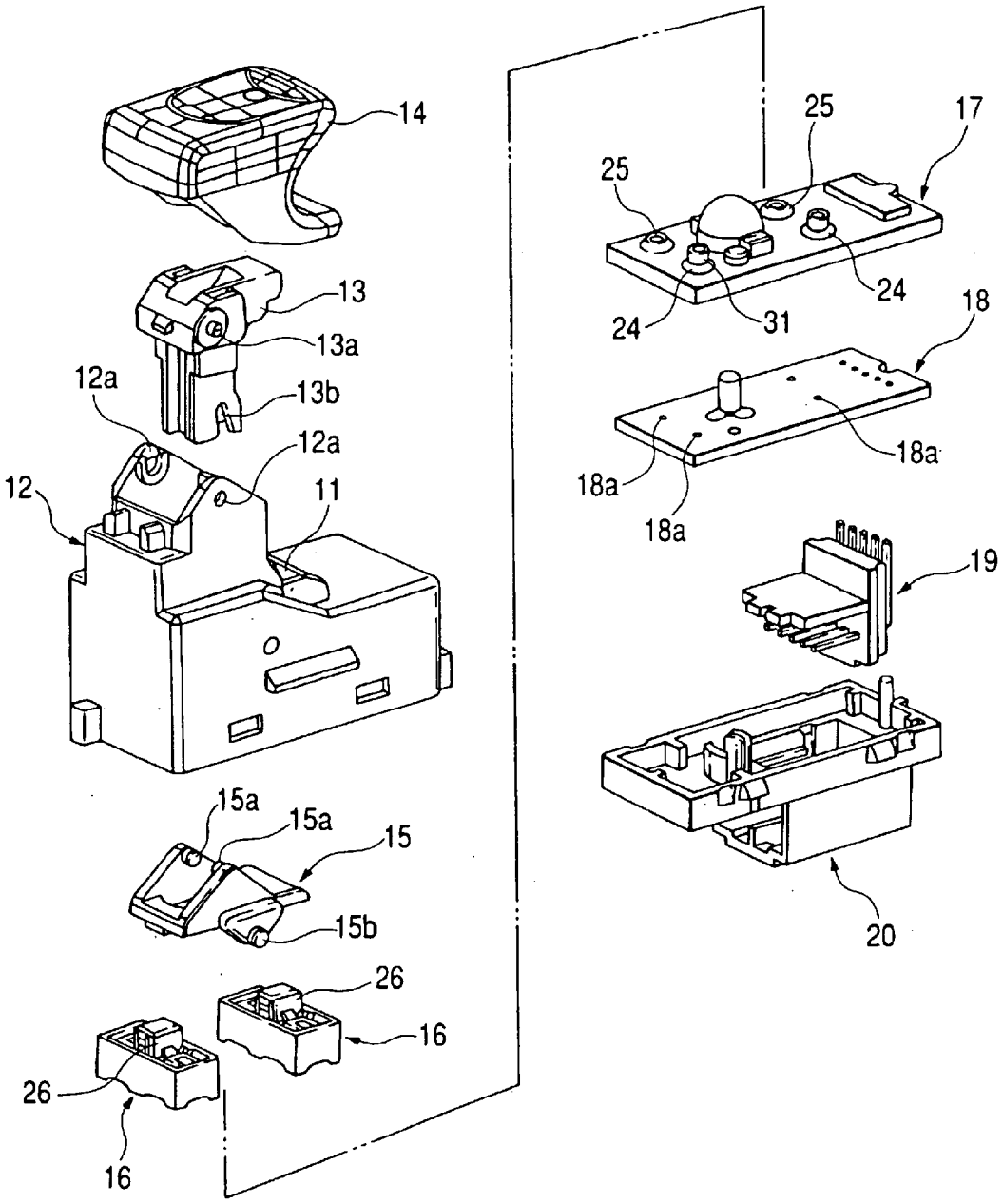
FIG. 6 is an exploded perspective view of FIG. 4.

The two-stage operation switch apparatus as multi-stage push operating switch device is utilized as a part of an automatic window unit of an automobile. As shown in FIG. 4 to FIG. 6, the switch apparatus includes, a case 12 forming an outer shell with an opening 11, a knob holder 13 a part of which is exposed at the opening 11, and which is supported for rocking motion by a shaft 13*a* which is held by bearings 12*a* of the case 12, a manually operable knob 14 which is fitted and fixed on the knob holder 13, a lever 15 linked with the knob holder 13 by way of pins 15*a* respectively engaged with engagement notch portions 13*b* of the knob holder 13, which is rocked by operating the manually operable knob 14, the lever 15 being supported for rocking motion by the case 12 byway of the shaft 15*b*, a switch device 16 which is operated by a slider 26 being pushed down by the rocking motion of the lever 15, a rubber mat 17 on which rubber switches 24, 25 having movable contacts 24*a*, 25*b* of the switch device 16, respectively, are integrally molded by the rubber mat die, a printed board 18 being mounted so that it is covered from above by the rubber mat 17, and provided with fixed contacts 18*a* on which the movable contact 24*a*, 25*a* are brought into contact individually, a pin holder 19 having a plurality of pins to be inserted into connecting holes of the printed board 18, and a cover 20 which contains the pin holder 19, the printed board 18, the rubber mat 17, the switch device 16 and the lever 15, an d the like, and assembled by being covered with the case 12.

As shown in FIG. 5, the manually operable knob 14 is snap fastened on the know holder 13.

Hereinafter, a movement of the slider 26, when the manually operable knob 14 is operated, will be explained.

In FIG. 5, when the manually operable knob 14 is lifted by hooking a hand finger in a recessed area on the right side surface, the knob holder 13 is pivoted in a counterclockwise direction about the shaft 13*a* of the knob holder 13. Then, the lever 15, which is linked by way of the pins 15*a* with the engagement notch portions 13*b*, is pivoted in a clockwise direction about the shaft 15*b*. Consequently, the right edge side of the lever 15 moves down and pushes down the slider 26 disposed below, provided in the right side switch device 16 out of the two switch devices 16.

In the meantime, when the upper surface of the manually operable knob 14 in a state as shown in FIG. 5 is pressed, the knob holder 13, is pivoted about the shaft 13*a* in a clockwise direction, and the lever 15, which is linked by way of the pins 15*a* with the engagement notch portions 13*b*, is pivoted in a counterclockwise direction about the shaft 15*b*. Consequently, the left edge side of the lever 15 moves down and pushes down the slider 26 disposed below, provided in the left side switch device 16 out of the two switch devices 16.

Next, a switch device 16 will be explained.

Figure 1:
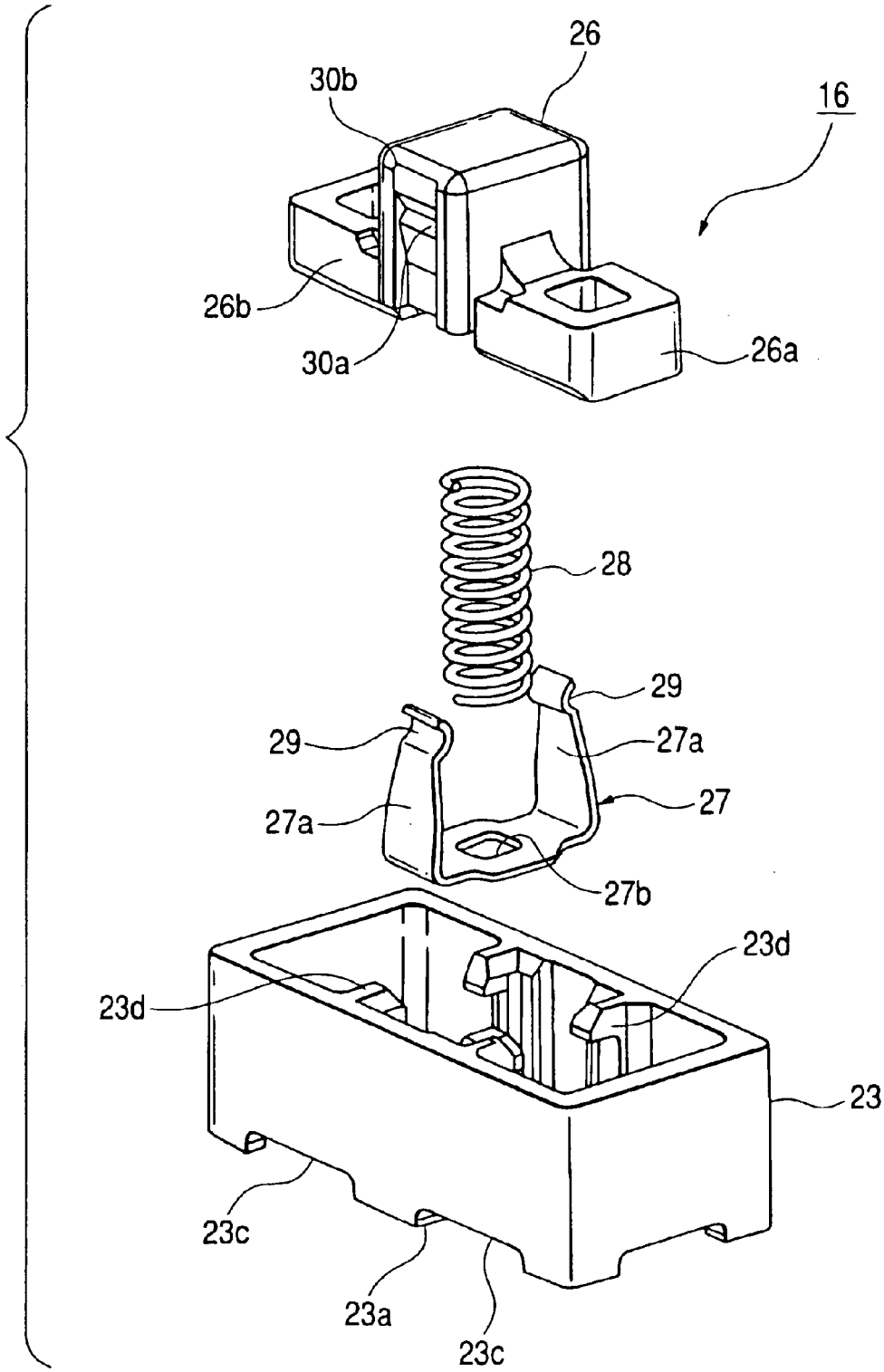
FIG. 1 is an exploded perspective view of the multi-stage push operating switch device relating to one embodiment of the present invention.
Figure 2A:
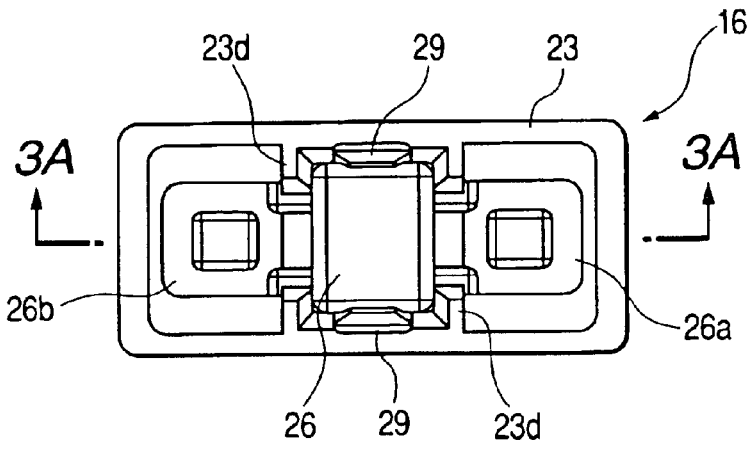
FIG. 2A is a plan view of the multi-stage push operating switch device.
Figure 2B:
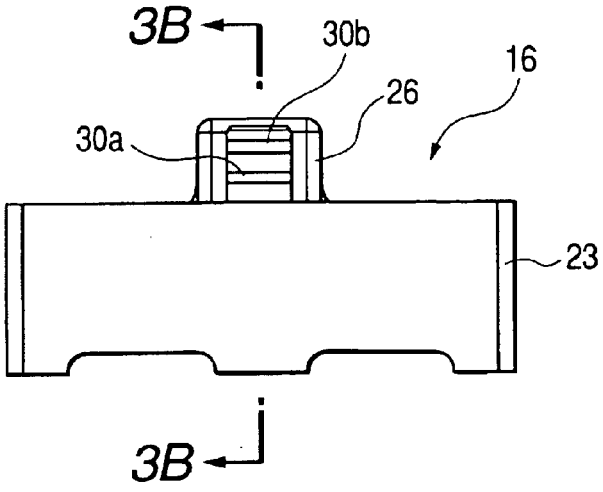
FIG. 2B is a front view of the multi-stage push operating switch device.
Figure 2C:
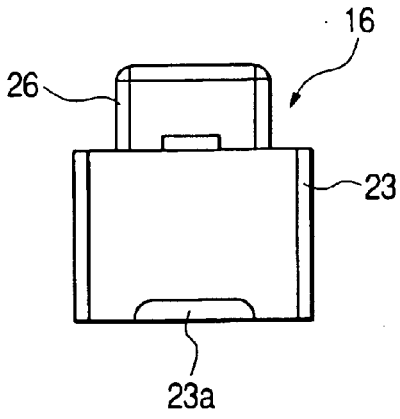
FIG. 2C is a side view of the multi-stage push operating switch device.
Figure 3A:
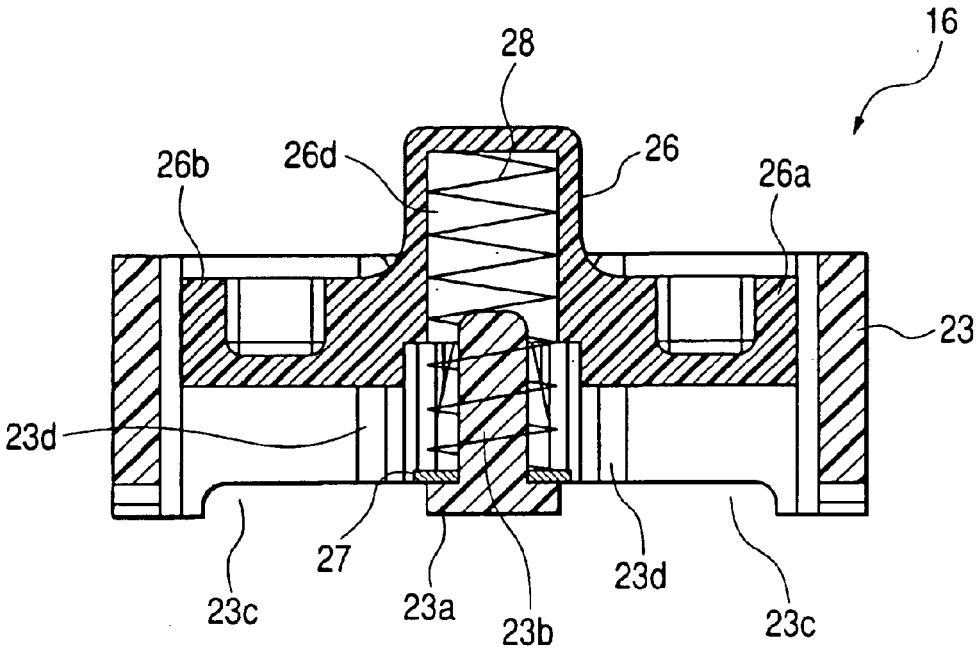
FIG. 3A is a cross sectional view taken along the line 3*a*—3*a* of FIG. 2A.
Figure 3B:
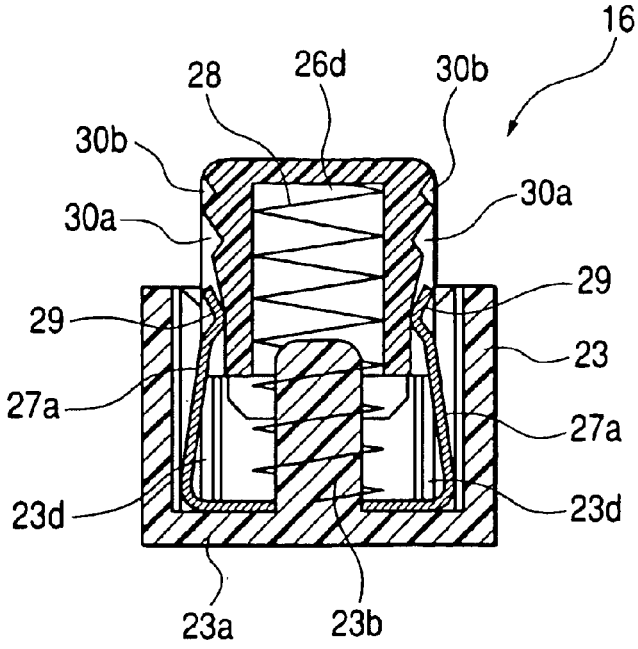
FIG. 3B is a cross sectional view taken along the line 3*b*—3*b* of FIG. 2B.
Figure 7:
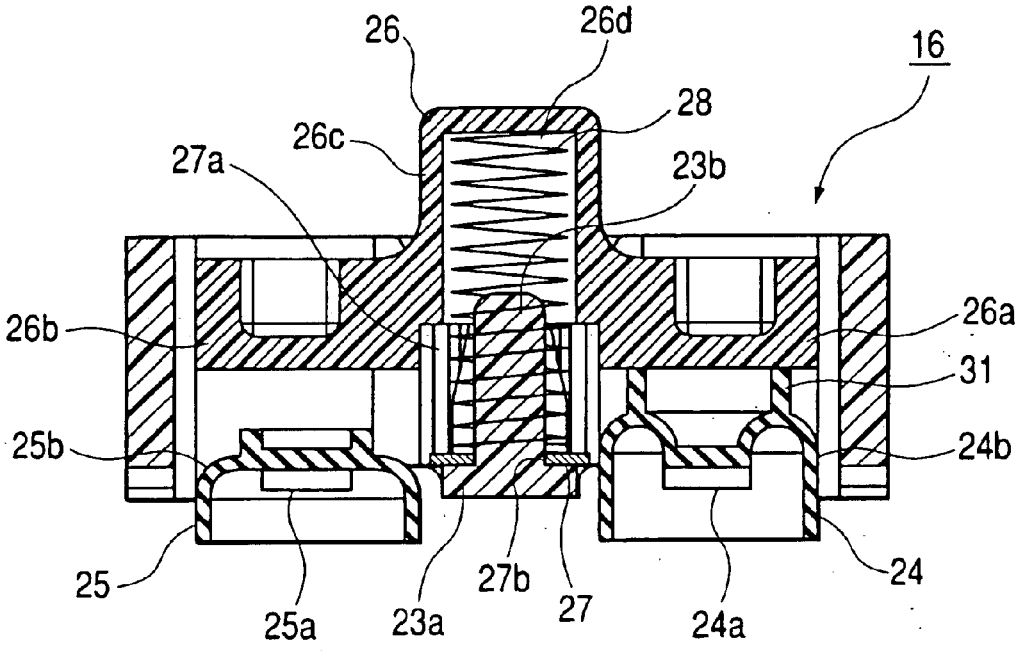

As shown in FIG. 1, FIG. 7 and the like, the switch device 16 includes a holder 23, a first rubber switch 24 having a dome 24*b* provided with a movable contact 24*a* on an inner ceiling; a second rubber switch 25 having a dome 25*b* provided with a movable contact 25*a* on an inner ceiling; a printed board 18 on which a fixed contact 18*a* is formed; a slider 26 provided with an actuating portions 26*a*, 26*b* for pressing the domes 24*b*, 25*b* of the first and the second rubber switches 24, 25, respectively, the slider being movable in a direction to apply a pressure onto each of the domes 24*b*, 25*b*; a plate spring 27 mounted in fixed manner onto the holder 23; a coil spring 28 urged to a direction to space the slider 26 away from the printed board 18; engagement sections 29 for giving click feeling, which are provided on the plate spring 27; engagement sections 30*a*, 30*b* provided on the slider 26, which are to be engaged with the engagement sections 29 for giving click feeling; and a pressing force absorbing section 31 provided on the first rubber switch 24.

The holder, 23 is formed in a box shape of rectangular parallelepiped, the top side and the bottom side being open. A bottom plate 23*a* runs between midsections of lower edges of two opposing side walls having a narrower distance therebetween, and a supporting rod 23*b* is installed upright from the upper surface central position of the bottom plate 23*a*, the supporting rod 23*b* is for supporting the lower edge of the coil spring 28. A basement of the supporting rod 23*b* is formed to be a shape having a rectangle cross-section, and the plate spring 27 is fitted therein. Further, the bottom surface of the holder 23 forms openings 23*c*, 23*c* separated by the bottom plate 23*a*. As shown in FIG. 7, the first and the second rubber switches 24, 25 are disposed in these openings 23*c*, 23*c*, respectively. The reference number 23*d* indicates guide units respectively provided on the inner side surfaces of the holder 23, which guide the slider 26 in vertical direction.

The plate spring 27 is made of a spring, and on upper edges of the plates 27*a*, 27*a*, the engagement sections 29, 29 for giving click feeling are respectively formed, each of which includes projections formed by bending the upper edge inwardly with arc-shaped cross section. Further, a fitting hole 27*b* having a rectangle shape to be fitted into the aforementioned basement of the supporting rod 23*b* is formed on the bottom plate of the plate spring 27. The plate spring 27 allows the fitting hole 27*b* to be fitted into the basement of the supporting rod 23*b*, as well as resiliently installing a lower edge of a coil spring 28, whereby the plate spring 27 is fixed on the holder 23.

The first rubber switch 24 includes a dome 24*b* provided on its inner surface ceiling with a movable contact 24*a* made of conductive rubber, and on its outer surface ceiling, a pressing force absorbing section 31 of tubular projection is integrally formed. The pressing force absorbing section 31 is brought into contact with the bottom surface of the actuating portion 26*a* of the slider 26, in an inoperative condition as shown in FIG. 7. After the movable contact 24*a* of the first rubber switch 24 contacts the fixed contact 18*a*, the pressing force absorbing section 31 is deformed with pushing action, enabling a further pushing down movement of the slider 26. In addition, the ceiling of the 24*a*, which is abase of the pressing force absorbing section 31, is expanded with an arc-shaped cross section and this portion can also absorb the pressing force by being deformed with pushing action.

The second rubber switch 25 includes a dome 25*b* provided on its inner surface ceiling with a movable contact 25*a* made of conductive rubber. In the present embodiment, the height of the second rubber switch is set lower than the ceiling upper surface of the first rubber switch 24.

As shown in FIG. 6, the first rubber switch 24 and the second rubber switch 25 are integrally provided on the rubber mat 17, which is molded with the rubber mat die. In this example, two pairs of the first rubber switch 24 and the second rubber switch 25 are provided respectively corresponding to the two switch devices 16.

The slider 26 is structured in inverted T-shape, including actuating portions 26*a*, 26*b*, respectively pushing down the first rubber switch 24 and the second rubber switch 25 arranged down below, an operating section 26*c* projecting upwardly in the midsection between the actuating portions 26*a*, 26*b*, a hollow 26*d* provided internally from the lower surface of the operating section 26*c*, and the engagement sections 30*a*, 30*b* to give a click feeling, provided on both side surfaces of the operating section 26*c*. The upper edge of the coil spring 28 is contained in the hollow 26*d* and held therein.

In addition, the actuating portions 26*a*, 26*b* are disposed respectively above the domes 24*b*, 25*b* of the first rubber switch 24 and the second rubber switch 25. When the slider 26 is pushed down, the actuating portions 26*a*, 26*b* successively pressurizes and inverts the 24*b*, 25*b*, and establishes a connection between the movable contacts 24*a*, 25*a*, and the fixed contacts 18*a*, 18*a* of the printed board 18, respectively. A setting is made such that the inversion movement of the domes 24*b*, 25*b* in this situation does not provide a click feeling.

The engagement sections 30*a*, 30*b* are structured being provided with concave portions vertically at two positions, and the engagement sections 29 of the plate spring 27 slide on the side surfaces of the slider 26, go over the bumps and drop into the dips, respectively, thereby providing click feelings twice. The timing to provide such twice-click feelings is set to correspond to when the domes 24*b*, 25*b* of the first and, the second rubber switches 24, 25 are inverted, or when the movable contacts 24*a*, 25*a* are brought into contact with the fixed contacts. 18*a*, 18*a*.

Next, a movement of the multistage push operating switch device of the present embodiment will be explained with reference to FIG. 7 to FIG. 9. Please note that a fixed contact is omitted in FIG. 7 to FIG. 9.

In the multi-stage push operating switch device in inoperative condition as shown in FIG. 5 and FIG. 7, an operator operates the manually operable knob 14 and tilts the lever 15 as described above. The operating force applied to the manually operable knob 14 is transmitted from the actuating portion 26*a* of the slider 26 to the pressing force absorbing section 31 by way of the lever 15 Then, the slider 26 moves down while pushing and shrinking the coil spring 28. When the slider 26 moves downwardly, the pressing force absorbing section 31 starts a yieldable deformation of the dome 24*b* of the first rubber switch 24, while the pressing force absorbing section 31 keeps a shape of its own to some extent. Then, as shown in FIG.8, the dome 24*b* is subjected to the yieldable deformation with the pressing movement of the manually operable knob 14, the movable contact 24*a* provided on the dome 24*b* is brought into contact with the fixed contact 18*a*, and the fixed contact 18*a* is made conductive (ON) by way of the movable contact 24*a*. Accordingly, an electric signal for the first stage is outputted from the rubber switch 24 in response to the tilted operation of the manually operable knob 14 (i.e., the push-down amount of the slider 26). Further, at a timing when the movable contact 24*a* is brought into contact with the fixed contact 18*a*, the engagement section 30*a* of the slider 26 drops into the engagement section 29 of the plate spring 27, thereby providing the first stage click feeling.

When the manually operable knob 14 in a state of FIG. 8 is further operated, the slider 26 is pushed down further. At this timing, since deformation of the dome 24*b* of the right-side first rubber switch 24 has already been completed. (the movable contact 24*a* is brought into contact with the fixed contact 8*a*), the pressing force absorbing section 31 absorbs the pressing force of the actuating portion 26*a*, while being yieldably deformed, so as not to interfere with further downward movement of the slider 26. Then, the actuating portion 26*b* is brought into contact with the upper surface of the dome 25*b* of the second rubber switch 25, and starts the yieldable deformation of the dome 25*b*. As shown in FIG. 9, the dome 25*b* is subjected to the yieldable deformation by the pressing movement of the manually operable knob 14, and it is inverted. Then, the movable contact 25*a* provided on the dome 25*b* is brought into contact with the fixed contact 18*a* opposing thereto, and the fixed contact 18*a* is made conductive (ON) by way of the movable contact 25*a*. Accordingly, the second stage electric signal is outputted from the rubber switch 25 in response to the tilting operation of the manually operable knob 14 (i.e., the push-down amount of the slider 26). Further, at the timing when the movable contact 25*a* is brought into contact with the fixed contact 18*a*, the engagement section 30*b* of the slider 26 is engaged with the engagement section 29 of the plate spring 27, thereby providing the second stage click feeling.

When the manually operable knob 14 in such a tilted condition as described above is released, the slider 26 is pushed up due to the resilient forces of the coil spring 28 having, been contracted (together with restoring force of the dome 24*b*, 25*b*). Then, the slider 26 returns to the inoperative condition as shown in FIG. 7, and the manually operable knob 14 also returns to the inoperative condition as shown in FIG. 5. Simultaneously, the movable contacts 24*a*, 25*a* are spaced away respectively from the fixed contacts 18*a*, 18*a*, having been in contact state, and then, a pair of the rubber switches 24, 25 returns to be nonconductive (OFF).

When the operator operates the manually operable knob 14, in the inoperative condition as shown in FIG. 7, into a direction opposite to that as described above, the lever 15 is tilted to the inverse side in a manner as described above, and the slider 26 of the other switch device 16 is pushed down. Then, electric signals of the first stage and the second stage are outputted from the pair of the rubber switches 24, 25 in response to the push-down amount of the slider 26, thereby providing click feeling at each stage, similarly as when the aforementioned switch device 16 is pushed down.

In the present embodiment as describe above, the switch device includes a first rubber switch 24 having a dome provided with a movable contact 24*a* on an inner ceiling; a second rubber switch 25 having a dome provided with a movable contact 25*a* on an inner ceiling; a plate spring 27 mounted in fixed manner onto the holder 23; a coil spring 28 urged to a direction to space the slider 26 away from the printed board 18; engagement sections 29 for giving click feeling, which are provided on the plate spring 27; engagement sections 30*a*, 30*b* to be engaged with the engagement sections 29 for giving click feeling, which are provided on the slider 26; and a pressing force absorbing section 31 provided on the first rubber switch 24. Therefore, it is possible to obtain clear two-stage click feelings irrespective of the distance between the first and the second rubber switches 24, 25, whereby the distance between the first and the second rubber switches 24, 25 can be made narrower, achieving a reduction of planar dimension of a product. Further, even when an inversion load error occurs in the rubber switches 24, 25 due to molding by the rubber mat die, such an error does not affect the two-stage click occurrence and thus it is possible to securely obtain the click feeling. Accordingly, it is not necessary to reproduce the rubber switch thereby preventing an extension of developing period of time.

Next, another embodiment of the present invention will be explained. FIG. 10 is an illustration for describing this embodiment.

The only difference from the previous embodiment is that engagement sections 32*a*, 32*b* for giving click feeling are provided on the inner surface of the slider 26.

In other words, as shown in FIG. 10, the engagement sections 32*a*, 32*b* for giving a click feeling are provided on both opposing side walls on the inner surface of the slider 26.

Further, the plate spring 27 is fixed on the printed board 18, as well as the plates 27*a*, 27*a* formed by bending the both edges upwardly are arranged within the internal hollow of the slider 26, and the engagement sections 33, 33 of the both plates 27*a*, 27*a* are respectively brought into a pressure contact with the both walls on which the engagement sections 32*a*, 32*b* of the slider 26 are provided.

Also in this second embodiment, similarly to the previous embodiment, the pushing down movement of the slider 26 generates the-two-stage click feelings, when the engagement section 33 of the plate spring 27 slides relative to the engagement sections 32*a*, 32*b* of the slider 26, and are engaged therewith.

Since the other structure of the second embodiment is the same as that of the previous embodiment, detailed explanations will be omitted.

It is to be noted that in each of the aforementioned embodiments, the engagement sections of the plate spring 27 and the engagement sections of the slider 26, i.e., the projections and depressions can be provided in a manner of inversed relation.

In FIG. 4 and FIG. 5 of each embodiment, two sets of automatic window unit having two manually operable knobs 14, 14 and two levers 15, 15, and four units of multi-stage push operating switch devices 16 are shown. However this number of units can be modified in accordance with the number of pairs. That is, even in the case where arbitrary n units of manually operable knobs, n units of levers, 2n units of multi-stage push operating switch devices are provided, a similar effect can be obtained. In other words, such a similar effect can also be obtained when only one manually operable knob, one lever, and two multi-stage push operating switch devices are provided.

As described above, according to the present invention, it is possible to obtain clear click feelings irrespective of the distance between the first and the second rubber switches, whereby the distance between the first and the second rubber switches can be made narrower, achieving a reduction in planar dimension of a product. Further, even when an inversion load error occurs in the rubber switches molded by the rubber mat die, such an error does not affect the two-stage click occurrence and thus it is possible to securely obtain the click feeling.

Accordingly, it is possible to prevent an extension of developing period of time.

What is claimed is:

1. A multi-stage push operating switch device comprising:

a holder;

a first rubber switch having a dome provided with a movable contact on an inner ceiling;

a second rubber switch having a dome provided with a movable contact on an inner ceiling;

a printed board on which a fixed contact is formed;

a slider provided with actuating portions for pressing the domes of the first and the second rubber switches, respectively, the slider being movable in a direction to apply a pressure onto each of the domes;

a plate spring mounted in a fixed manner onto the holder;

a coil spring urged to a direction to space the slider away from the printed board;

engagement sections for giving click feelings, which are provided on the plate spring;

engagement sections to be engaged with the engagement sections for giving click feelings, which are provided respectively on side surfaces of the slider; and a pressing force absorbing section provided on the first rubber switch to absorb a pressing force from the slider.

2. The multi-stage push operating switch device according to claim 1, wherein the pressing force absorbing section is formed as a projection molded integrally with the dome of the first rubber switch.

3. The multi-stage push operating switch device according to claim 1, wherein the plate spring is provided with a bottom plate, and plates which are formed by bending edges of the bottom plate upwardly, and wherein the plate spring is mounted on the holder fixedly, by elastically contacting a lower edge of the coil spring with the bottom plate.

4. The multi-stage push operating switch device according to claim 1, wherein, a hollow is provided within the slider to contain and hold an upper edge of the coil spring, wherein a pair of engagement sections of the slider are respectively provided on both opposed sides on an outer surface of the slider, and wherein the first rubber switch and the second rubber switch are arranged in such a manner as sandwiching the hollow, and being positioned orthogonal with a line connecting the pair of the engagement sections of the sliders.

* * * * *